US006481927B2

(12) United States Patent
Rhodes

(10) Patent No.: US 6,481,927 B2
(45) Date of Patent: Nov. 19, 2002

(54) ASSEMBLY AND METHOD FOR JOINING A DRAIN PIPE AND A CATCH BASIN

(76) Inventor: Lester Kent Rhodes, P.O. Box 877, Beaver, OK (US) 73932

( * ) Notice: Subject to any disclaimer, the term of this patent is extended or adjusted under 35 U.S.C. 154(b) by 0 days.

(21) Appl. No.: 09/833,506

(22) Filed: Apr. 11, 2001

(65) Prior Publication Data

US 2002/0150428 A1 Oct. 17, 2002

(51) Int. Cl.[7] ..... E04B 1/682; F16L 17/00; F16L 33/16; F16J 15/48

(52) U.S. Cl. ..... 405/36; 277/315; 277/316; 277/605; 277/642; 277/646; 285/97; 285/100; 285/110

(58) Field of Search ..... 277/314–316, 277/605, 642, 646; 285/96, 97, 100, 110; 405/36, 52

(56) References Cited

U.S. PATENT DOCUMENTS

| | | | | | |
|---|---|---|---|---|---|
| 2,700,196 | A | | 1/1955 | Panhard | 52/204.597 |
| 2,701,899 | A | | 2/1955 | Krupp | 49/477.1 |
| 2,815,966 | A | | 12/1957 | House | 277/605 |
| 3,144,153 | A | | 8/1964 | Fuller | 215/12.1 |
| 3,222,076 | A | | 12/1965 | Hollingsworth | 277/605 |
| 4,313,619 | A | | 2/1982 | Clements | 280/124.13 |
| 4,375,104 | A | | 2/1983 | Starr | 376/203 |
| 4,593,727 | A | * | 6/1986 | Ulveling | 277/605 |
| 4,624,465 | A | | 11/1986 | Rogemont | 277/646 |
| 4,663,036 | A | * | 5/1987 | Strobl et al. | 405/52 |
| 4,741,542 | A | | 5/1988 | Kimerly | 277/316 |
| 4,870,783 | A | | 10/1989 | Hermann et al. | 49/477.1 |
| 4,955,641 | A | * | 9/1990 | Dent | 285/96 |
| 4,993,722 | A | | 2/1991 | Gundy | 277/314 |
| 6,076,836 | A | | 6/2000 | Bretschneider et al. | 277/642 |

* cited by examiner

*Primary Examiner*—Thomas B. Will
*Assistant Examiner*—Tara L. Mayo
(74) *Attorney, Agent, or Firm*—Kenneth M. Jack; Davis & Jack, L.L.C.

(57) ABSTRACT

An assembly and method of joining a pipe with a catch basin, the catch basin having an apertured side wall, the assembly and method including providing an elastomeric ring having an annular hollow expansion space, a foam injection port, a flow checking inflation valve for resesting fluid back flow within the foam injection port, and having a slide stop extending outwardly from the elastomeric ring; inserting the elastomeric ring into the catch basin's aperture; inserting an end of the pipe through the elastomeric ring; and injecting a closed cell resilient foam through the fluid injection port for expansion within the expansion space, the expansion driving the ring's annular inner and outer surfaces inwardly and outwardly, forming a seal spanning between the pipe and the catch basin.

11 Claims, 4 Drawing Sheets

ASSEMBLY AND METHOD FOR JOINING A DRAIN PIPE AND A CATCH BASIN

FIELD OF THE INVENTION

This invention relates to ground water drainage systems comprising drainage pipes and catch basins. More particularly, this invention relates to methods and assemblies for joining such articles.

BACKGROUND OF THE INVENTION

Ground water drainage systems commonly comprise a cylindrical upwardly opening catch basin having at least a first drainage line or pipe extending laterally and outwardly therefrom. In such water drainage systems, the catch basin is commonly buried within the ground to a depth allowing the basin's upper opening to be substantially flush with the ground surface. The lateral lines or pipes of such system, whose openings necessarily underlie the basin's upper opening, extend beneath the ground to a desired drainage outlet point. The catch basins and lateral line pipes of such systems are commonly composed of polyvinyl chloride (PVC) plastic.

A commonly known method of joining such a lateral line PVC pipes to a catch basin comprises steps of cutting an aperture through a side wall of the PVC catch basin and driving outwardly through such aperture a heated conical mandrel, such mandrel drawing the edges of such aperture outwardly to form a nipple. Such mandrel forming method is necessarily precisely controlled to cause the outside diameter of the nipple to match the inside diameter of the PVC pipe, allowing the PVC pipe to be adhesively bonded to the nipple.

The above described common pipe joining method cannot be efficiently or economically performed in the field. Such method necessitates that the basin's lateral line fittings be fabricated in a plastics working shop in advance of installation of the drainage system in the field. Thus, utilization of such common method undesirably requires both the placement and size of lateral line fittings to be determined in advance of system installation.

The instant inventive assembly and method overcomes problems set forth and described above by providing an elastomeric foam expansible ring adapted for compressively sealing an annulus within a catch basin side wall aperture and surrounding a lateral line drainage pipe.

BRIEF SUMMARY OF THE INVENTION

A core structural component utilized in the instant inventive assembly and method comprises an elastomeric ring having an annular outer surface, an annular inner surface, and having a hollow annular expansion space. Preferably, the annular outer surface forms annular forwardly facing and rearwardly facing slide stops which, in combination with the annular outer surface form an annular outwardly opening channel. Necessarily, a fluid injection port extends through a forward or rearward side wall of the elastomeric ring, such port allowing injection of closed cell resilient foam in its fluid state into the annular hollow expansion space. Also necessarily, fluid flow within the fluid injection port is controlled by fluid flow control means such as a check valve or a pinch valve. Preferably, the elastomeric ring is composed of vulcanized natural or synthetic rubber.

The instant inventive assembly and method preferably further comprises an upwardly opening water catching basin. Preferably, such basin is cylindrical in shape, having either a circular lateral cross section or a rectangular or substantially square lateral cross section. While the catch basin may suitably be composed of aluminum, stainless steel, or galvanized steel, the catch basin is preferably composed of polyvinyl chloride (PVC) plastic.

The instant inventive assembly and method preferably further comprises a lateral line drainage pipe extending laterally from a side wall of the water catching basin. While such pipe may be suitably composed of iron, steel, or fired clay, such pipe is preferably composed of PVC plastic.

Finally, the instant inventive assembly and method preferably further comprises closed cell resilient foam of the type which, in its fluid state, may be injected through, for example, a check valve stem and thence into the annular hollow expansion space of the elastomeric ring. Preferably, the closed cell resilient foam comprises polyether urethane foam, or polyester urethane foam. However, polyethylene, phenolic, polystyrene, polypropylene, and polyisocyanurate foams may be suitably substituted.

It may be observed that for any size or gauge of water catching basin, it may be desirable under differing circumstances to extend laterally therefrom differently sized lateral drainage pipes. For example, where the catch basin is required to drain a large volume of water in a short length of time, it may be desirable to extend therefrom a large six inch lateral line. Alternately, where the catch basin is intended to handle a smaller volume of water, it may be suitable to extend therefrom a smaller three inch lateral line. In order to utilize the instant inventive assembly and method for attachment of such varying sizes of lateral lines to the catch basin, it is preferred that an operator have available several elastomeric rings, such rings being closely fitted for usage with common sizes of lateral line pipes.

According to the method of the instant assembly and method, an appropriately sized circular lateral line receiving aperture is cut through a side wall of a water catching basin. Where, for example, a six inch PVC lateral line or pipe is to be extended from the catch basin, the diameter of the lateral line receiving aperture is preferably approximately ten inches, allowing an elastomeric ring, such as described above, to fill the approximately two inch annulus which is formed upon axial extension of such pipe into such aperture.

Upon cutting such ten inch aperture, an appropriately sized elastomeric ring, configured as described above, is flexibly placed within the aperture, allowing said ring's forward slide stop to contact the outer surface of the wall of the catch basin. Where the slide stops of the elastomeric ring form an outwardly opening channel, the edge of said aperture is nestingly positioned within such channel. Upon installation of the ring upon the catch basin, the exemplary six inch PVC pipe is extended through the pipe receiving space of the elastomeric ring.

Upon configuration of the pipe, elastomeric ring, and catch basin as described above, the closed cell resilient foam in its fluid state is compressively injected through the foam injection port, allowing such foam to expand within the expansion space, driving the annular inner and outer surfaces of the elastomeric ring inwardly and outwardly, and causing such ring to seal the annulus between the outer surface of the pipe and the inner edge of the catch basin aperture. Such seal dually functions as a means for fixedly attaching the pipe to the catch basin and as means for preventing leakage of water.

Accordingly, it is an object of the present invention to provide an assembly and method for joining lateral line drainage pipes and catch basins utilizing a resilient foam expansible sealing ring.

It is a further object of the present invention to provide such pipe joining assembly and method which is conveniently assemblable and utilizable in the field.

Other and further objects, benefits, and advantages of the present invention will become known to those skilled in the art upon review of the Detailed Description which follows, and upon review of the appended drawings.

DETAILED DESCRIPTION OF THE PREFERRED EMBODIMENT

Figure 3:
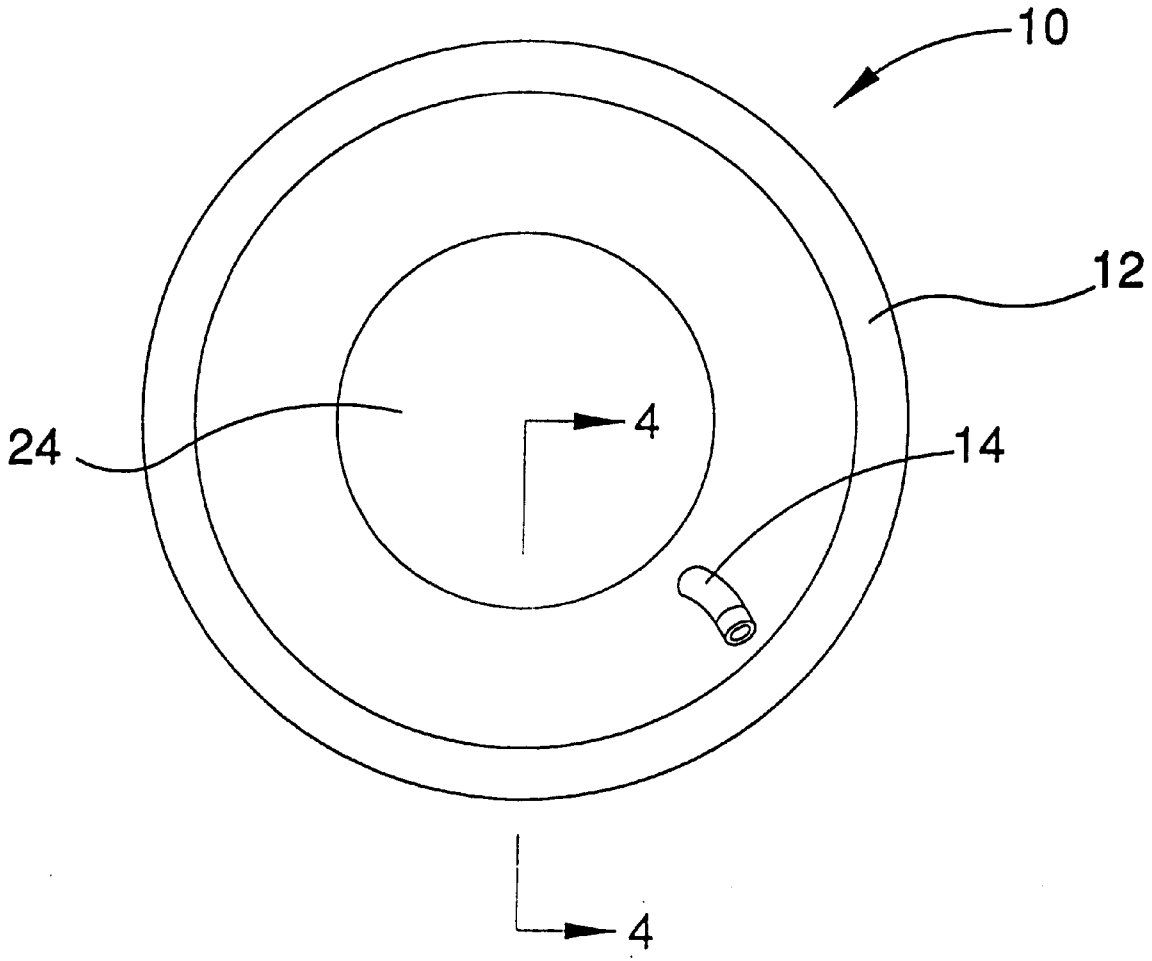
FIG. 3 is a view of the forward end of the elastomeric ring component of the instant inventive assembly and method.
Figure 4:
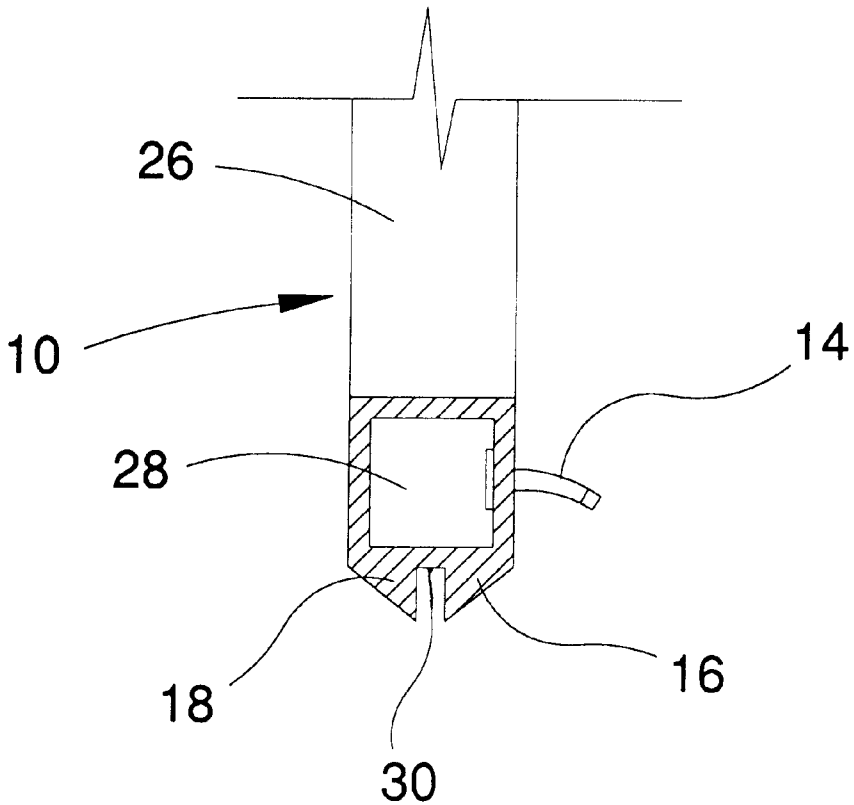
FIG. 4 is a sectional view as indicated in FIG. 3.

Referring to now to the drawings, and in particular to FIG. 3, the elastomeric ring assembly utilized in the present inventive assembly and method is referred to generally by reference arrow 10. Referring simultaneously to FIGS. 3 and 4, a lateral line or drain pipe receiving space 24 is annularly surrounded and defined by an annular inner surface 26. The elastomeric ring 10 further has an annular outer surface 30, said surface having at its forward end a slide stopping ridge 16. Necessarily, said ridge 16 forms a rearwardly facing basin wall engaging surface. While slide stopping ridge 16 may suitably to configured in the form of a plurality of radially spaced contact points (not depicted), said ridge preferably is configured as the depicted continuous annular ridge. Further, while a single forward slide stopping ridge 16 may be suitably utilized, it is preferred that said ridge 16 be paired with a rearward slide stopping ridge 18, such ridge also preferably being annularly configured. Preferably, ridges 16 and 18, in combination with annular outer surface 30 form and define an annular outwardly opening channel, as depicted. Referring simultaneously to FIGS. 3 and 4, the annular outer surfaces of ridges 16 and 18 preferably form debris deflecting chamfered edges 12.

Further referring to FIGS. 3 and 4, a hollow expansion space 28 extends annularly within ring 10, such space being positioned between the annular inner surface 26 and the annular outer surface 30. Preferably, fluid back flow control means in the form of an inflation check valve 14 extends through a foam injection port extending through the forward side wall of ring 10. Suitably, said back flow control means may be configured as a tube and pinch valve (not depicted). Also suitably, the foam injection port and back flow control means may be alternately situated upon the rearward wall of ring 10. Preferably, ring 10 is composed of durable vulcanized synthetic or natural rubber.

Figure 1:
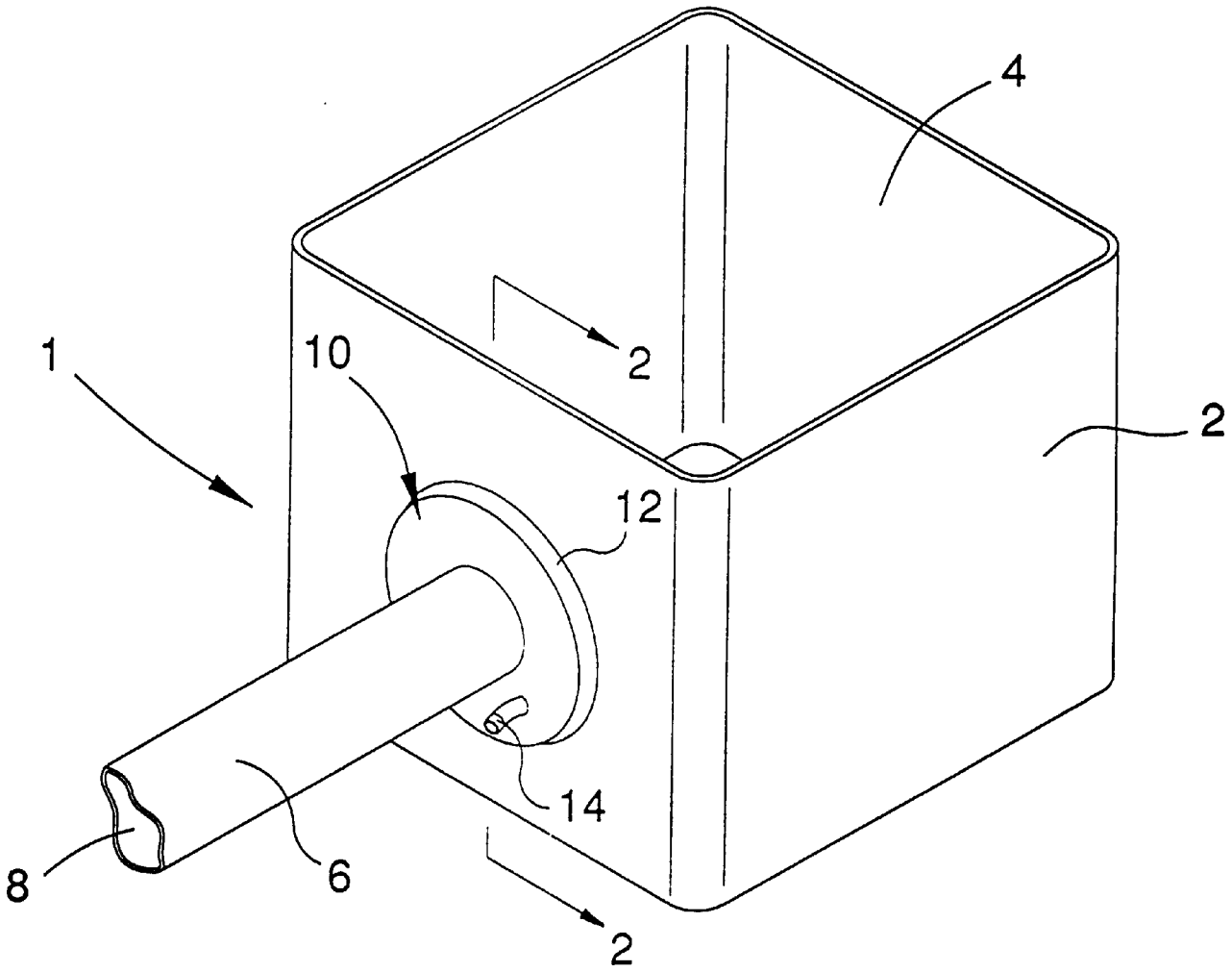
FIG. 1 is an isometric view of the assembly utilized in the instant inventive assembly and method.
Figure 2:
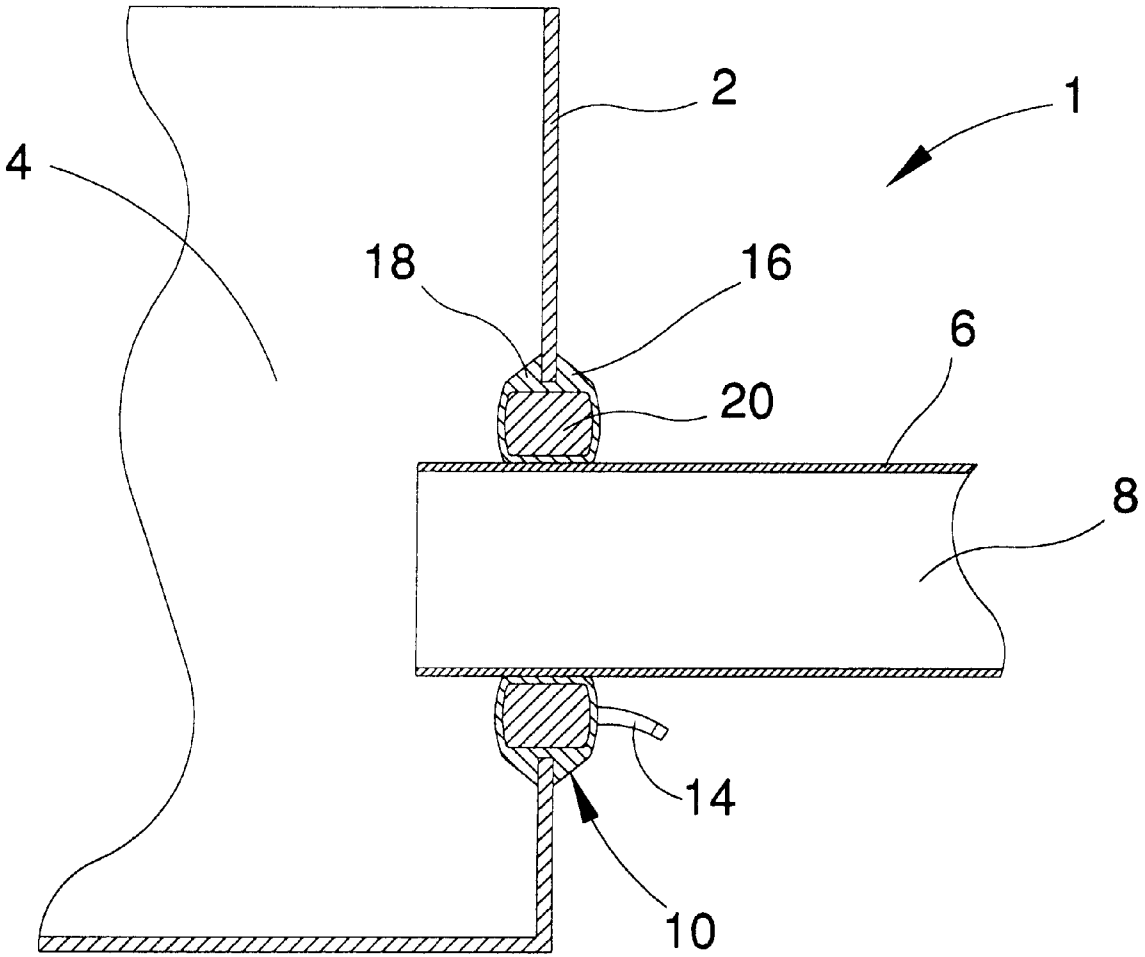
FIG. 2 is a sectional view as indicated in FIG. 1.

Referring simultaneously to FIGS. 1 and 2, an upwardly opening catch basin 2 has a side wall through which a circular ring receiving aperture is cut. Preferably, the diameter of ring receiving aperture is fitted for annular nesting within, referring to FIG. 4, the annular outwardly opening channel of ring 10. Through flexible bending of ring 10, said ring may be mounted as depicted in FIG. 2, allowing the annular slide stopping ridges 16 and 18 to effectively encase inner and outer surfaces of the side wall of catch basin 2.

Referring simultaneously to FIGS. 1, 2, and 3, upon installation of the elastomeric ring 10, as depicted, a lateral line drainage pipe 6 is extended through the lateral line receiving space 24. Thereafter, referring further simultaneously to FIG. 4, a closed cell resilient foam 20 is injected in its fluid state through inflation check valve 14, and thence into the expansion space 28, causing said space to outwardly expand, as depicted in FIG. 2.

Referring further simultaneously to FIGS. 1–4, such pressurized injection of foam 20 into expansion space 28 causes the annular outer surface 30 to press against the aperture within the wall of catch basin 2, and causes the annular inner surface 26 to press against the outer wall of pipe 6, said counter pressure fixing pipe 6 in place with respect to catch basin 2, and forming an occlusively sealed annulus therebetween.

Referring simultaneously to FIGS. 1 and 2, upon sealing installation of pipe 6 and ring 10, as depicted, water flowing into the interior space 4 of catch basin 2 may drain through the interior bore 8 of lateral drain pipe 6 without leakage.

While the principles of the invention have been made clear in the above illustrative embodiment, those skilled in the art may make modifications in the structure, arrangement, portions, components, and method and process steps of the invention without departing from those principles. Accordingly, it is intended that the description and drawings be interpreted as illustrative and not in the limiting sense, and that the invention be given a scope commensurate with the appended claims.

I claim:

1. A pipe joint assembly comprising:

(a) an elastomeric ring having an annular inner surface defining a lateral line receiving space, an annular outer surface having a forward end and a rearward end, an annular expansion space between the annular inner surface and annular outer surface, a front wall, a rear wall, and having a foam injection port extending through the front or the rear wall;

(b) means for resisting fluid back flow within the foam injection port; and, (c) a first slide stop extending outwardly from the forward end of said annular outer surface, said slide stop having a rearwardly facing basin wall engaging surface, said surface being positioned rearwardly from the front wall.

2. The pipe joint assembly of claim 1 further comprising a second slide stop extending outwardly from the rearward end of the annular outer surface of the elastomeric ring, the second slide stop having a forwardly facing basin wall engaging surface.

3. The pipe joint assembly of claim 2 wherein the rearwardly and forwardly facing basin wall engaging surfaces are annular, said surfaces in combination with the annular outer surface of the elastomeric ring defining an outwardly opening annular channel.

4. The pipe joint assembly of claim 3 further comprising a catch basin having a wall, said wall having a ring receiving aperture, said aperture having an annular edge, the elastomeric ring being mounted upon the catch basin so that said annular edge nests within the said ring's outwardly opening annular channel.

5. The pipe joint assembly of claim 4 further comprising a drain pipe extending through the elastomeric ring's lateral line receiving space.

6. The pipe joint assembly of claim 5 further comprising closed cell resilient foam injected into the elastomeric ring's expansion space, said foam respectively driving said ring's annular outer and inner surfaces outwardly and inwardly against the annular edge of the catch basin's ring receiving aperture, and against the drain pipe.

7. The pipe joint assembly of claim 6 wherein the closed cell resilient foam is selected from the group of polyether urethane foam, polyester urethane foam, polyethylene foam, phenolic foam, polystyrene foam, polypropylene foam, and polyisocyanurate foam.

8. The pipe joint assembly of claim 6 wherein the means for resisting fluid back flow comprises a check valve or a pinch valve.

9. The pipe joint assembly of claim 8 wherein the elastomeric ring comprises vulcanized rubber.

10. The pipe joint assembly of claim 9 wherein the catch basin and the drain pipe comprise polyvinyl chloride.

11. A method of joining a drain pipe and a catch basin, the catch basin having a side wall, the method comprising steps of:

(g) cutting a lateral line receiving aperture through the side wall;

(h) providing an elastomeric ring having an annular inner surface defining a drain pipe receiving space, an annular outer surface, an annular expansion space between the annular inner surface and annular outer surface, a front wall, a rear wall, a foam injection port extending through the front or the rear wall, means for resisting fluid back flow within the foam injection port, and having at least a first slide stop extending outwardly from a forward end of said annular outer surface, the first slide stop being positioned rearwardly from the front wall;

(i) inserting the elastomeric ring into the lateral line receiving aperture so that the at least first slide stop engages the side wall of the catch basin;

(j) inserting an end of the drain pipe through the drain pipe receiving space of the elastomeric ring;

(k) injecting a closed cell resilient foam through the foam injection port; and, (l) expanding said foam within said expansion space, said foam expansion driving said annular inner and outer surfaces respectively inwardly and outwardly to form a seal spanning between the drain pipe and the catch basin.

* * * * *